US006663116B2

(12) United States Patent
Evans

(10) Patent No.: US 6,663,116 B2
(45) **Date of Patent: *Dec. 16, 2003**

(54) INDEPENDENT SUSPENSION VEHICLE TRUCK FOR SUPPORTING A GROUND CONTACTING DEVICE

(76) Inventor: Brian Lee Evans, P.O. Box 129, Nipomo, CA (US) 93444

( * ) Notice: Subject to any disclaimer, the term of this patent is extended or adjusted under 35 U.S.C. 154(b) by 0 days.

This patent is subject to a terminal disclaimer.

(21) Appl. No.: 10/186,738

(22) Filed: Jul. 1, 2002

(65) Prior Publication Data

US 2003/0006568 A1 Jan. 9, 2003

Related U.S. Application Data

(63) Continuation of application No. 08/762,255, filed on Dec. 9, 1996, now Pat. No. 6,416,064, which is a continuation of application No. 08/534,864, filed on Sep. 27, 1995, now abandoned, which is a continuation of application No. 08/172,109, filed on Dec. 23, 1993, now abandoned.

(51) Int. Cl.[7] ..... A63C 17/06

(52) U.S. Cl. ..... 280/11.225; 280/11.221; 280/11.28

(58) Field of Search ..... 280/11.221, 11.225, 280/11.21, 11.22, 11.19, 11.27, 11.28, 11.25, 7.13, 87.042, 87.03, 87.41, 124.169, 124.177, 841

(56) References Cited

U.S. PATENT DOCUMENTS

| | | | | | |
|---|---|---|---|---|---|
| 296,571 | A | * | 4/1884 | Huckins et al. | 280/11.28 |
| 311,936 | A | * | 2/1885 | Wisewell | 280/11.28 |
| 1,772,333 | A | * | 8/1930 | Woelfer | 280/11.225 |
| 2,644,692 | A | * | 7/1953 | Kahlert | 280/11.221 |
| 3,649,038 | A | * | 3/1972 | Huckenbeck | 280/11.28 |
| 4,000,912 | A | * | 1/1977 | Donald et al. | 280/86.1 |
| 4,202,558 | A | * | 5/1980 | Olschewski et al. | 280/11.28 |
| 4,402,521 | A | * | 9/1983 | Mongeon | 280/11.225 |
| 4,708,352 | A | * | 11/1987 | Vullierme | 280/11.26 |
| 5,082,300 | A | * | 1/1992 | Cucurullo | 280/11.224 |
| 5,271,633 | A | * | 12/1993 | Hill, Jr. | 280/11.223 |
| 5,346,231 | A | * | 9/1994 | Ho | 280/11.208 |
| 5,462,295 | A | * | 10/1995 | Seltzer | 280/11.19 |
| 5,704,621 | A | * | 1/1998 | Lazarevich et al. | 280/11.28 |
| 6,416,064 | B1 | * | 7/2002 | Evans | 280/11.225 |

FOREIGN PATENT DOCUMENTS

| | | | | |
|---|---|---|---|---|
| EP | 558776 A1 | * | 9/1993 | A63C/17/02 |
| FR | 2500317 A | * | 8/1982 | A63C/17/00 |

* cited by examiner

*Primary Examiner*—Brian L Johnson
*Assistant Examiner*—Kelly E Campbell
(74) *Attorney, Agent, or Firm*—Patrick F. Bright

(57) ABSTRACT

A vehicle truck for supporting a ground contacting device, and an independent-suspension turnable skate vehicle truck which supports a wheel or wheels or a runner or ski, and a boot having in-line wheels or tandem wheels is provided. The independent-suspension turnable skate vehicle truck has one or more deflecting beams attached to a wheel axle hanger and the opposite end attached to a skate vehicle mounting structure. The deflecting beam has at least one horizontal component and/or at least one vertical component. The vertical components resist vertical deflection of the wheel axle hangers to restrict upward and downward movement of the wheels or other ground contacting portions. The horizontal component controls most twisting motions controlling turning of the deflecting beam and wobble of the wheel. The truck and mounting surface are adaptable to permit changes to the number of wheels or ground contacting portions, the position of the wheels, and the thickness of the wheels.

8 Claims, 12 Drawing Sheets

INDEPENDENT SUSPENSION VEHICLE TRUCK FOR SUPPORTING A GROUND CONTACTING DEVICE

This application is a continuation of application Ser. No. 08/762,255, filed Dec. 9, 1996 and is now U.S. Pat. No. 6,416,064, which is a continuation of application Ser. No. 08/534,864, filed Sep. 27, 1995 and now abandoned, which is a continuation of application Ser. No. 08/172,109, filed Dec. 23, 1993 and now abandoned.

BACKGROUND OF THE INVENTION

The present invention relates to a vehicle truck for supporting a ground contacting device, and in particular to an independent suspension truck which supports a wheel or wheels or a runner or ski, for example a roller skate boot has in-line wheels or tandem wheels.

Roller skates, skateboards, scooters, unicycles, wheel barrows, sleds and other weight carrying vehicles have been around for years. Each type of vehicle uses a different type of truck to steer depending on whether the device uses wheels, the number of wheels, and the configuration of the wheels, e.g. a single wheel, in-line wheels, tandem or staggered wheels. Presently no single truck exists which can perform all these functions. Some wheels may be mounted to a device which permits the wheels to turn while others have no device to actively turn the wheels, skis or blades. Most have no shock absorbing capability. Rough surfaces, rocks, cracks, etc. present hazards to in-line skates without some shock absorbing capability. Vibrations are transferred directly to the skater causing fatigue. In in-line skates, the vibration is multiplied by the number of wheels. In recent years the popularity of in-line roller skates has increased dramatically. However, these vehicles have various drawbacks, conventional in-line skates cannot be steered except by moving the entire set of wheels by applying significant force, since the wheels do not turn relative to the mounting structure. Turning on in-line skates is accomplished by slip, slide and increase or loss of friction on one or more of the wheels. The wheels turn in a single arc.

Another drawback is that most of the foregoing vehicles are not adaptable. The roller skate boot is configured to have a specific number of wheels, which are of a specified width. The boot cannot be modified to change the number of wheels or to permit an interchange with wheels of differing widths. In addition, the trucks can not be adjusted to change their shock absorbing characteristics, to alter their turning characteristics, or to resist bottoming out of the wheels against the bottom of the vehicle. Further, few if any vehicles allow for adjustment of the ride characteristics. Most vehicles cannot be reconfigured to use wheels, skis, blades or treads.

Furthermore, the trucks, or wheel supporting structures, for each particular type of vehicle are designed for use with only that type of vehicle and are not applicable to other formats. For example the trucks on an in-line roller skate can not be utilized on a scooter without significant redesign.

SUMMARY OF THE INVENTION

In view of the foregoing drawbacks it is an object of the present invention to provide a independent-suspension turnable skate vehicle truck which prevents the ground contacting portions, such as wheels) from bottoming out on the vehicle truck by providing flexible deflecting beams having one end attached to a truck axle hanger and the opposite end attached to a vehicle mounting platform. The end attached to the mounting platform is attached so that the deflecting beam part of the flexible deflecting member; meets the mounting platform at an acute angle, less than 90 degrees. The truck has a unitary construction, and may be made from plastic, graphite-like material, or other flexible material.

The deflecting beam has at least one horizontal component and/or at least one vertical component. The vertical components resist vertical deflection of the truck axle hangers to restrict upward and downward movement of the wheels or other ground contacting portions. The ability of these vertical components to resist upward and downward movement relates to the shock absorbing capability. In addition to acting as a shock absorber the vertical component also acts a center of movement for turning of the deflecting beam.

The horizontal component controls most twisting motions of the deflecting beam. As the thickness of the horizontal component is increased relative to its width, its resistance to twisting or deflection from a particular force applied to the axle hanger or mounting surface will increase. The horizontal component also acts as a dampener of side-to-side axle truck hanger wobble. The wider the horizontal component the less wobble there will be. If the horizontal deflection component is thick enough and is made of a sufficiently stiff enough material it will also act to resist vertical deflection, thereby eliminating the need for the vertical component.

The truck permits changes to the number of wheels or ground contacting portions, the position of the wheels, and the thickness of the wheels. The present invention may be converted from in-line to tandem configuration by simply changing the axles and wheels.

The unitary construction may have multiple attachment points to provide greater stability. No unitary independent suspension truck exists which provides shock absorption and prevents splaying of the wheels.

The deflection beam may have a variety of cross-sections so long as it resists vertical deflection, twist and allows for vibration absorption.

It is another object of the invention to provide a vehicle truck in which the ground contacting portions resist splaying outward under the weight of an occupant or load.

Another object of the invention to provide a vehicle truck which is adaptable for use on a skate, sled, scooter, wheel barrow, unicycle or most any other vehicle.

Yet another object of the invention is to provide a vehicle truck which can be reconfigured to change the number of, the size of, or position of ground contacting portions.

The foregoing and other objects of the present invention will be described in detail below with reference to the drawings.

DETAILED DESCRIPTION OF THE PREFERRED EMBODIMENT

Figure 1:
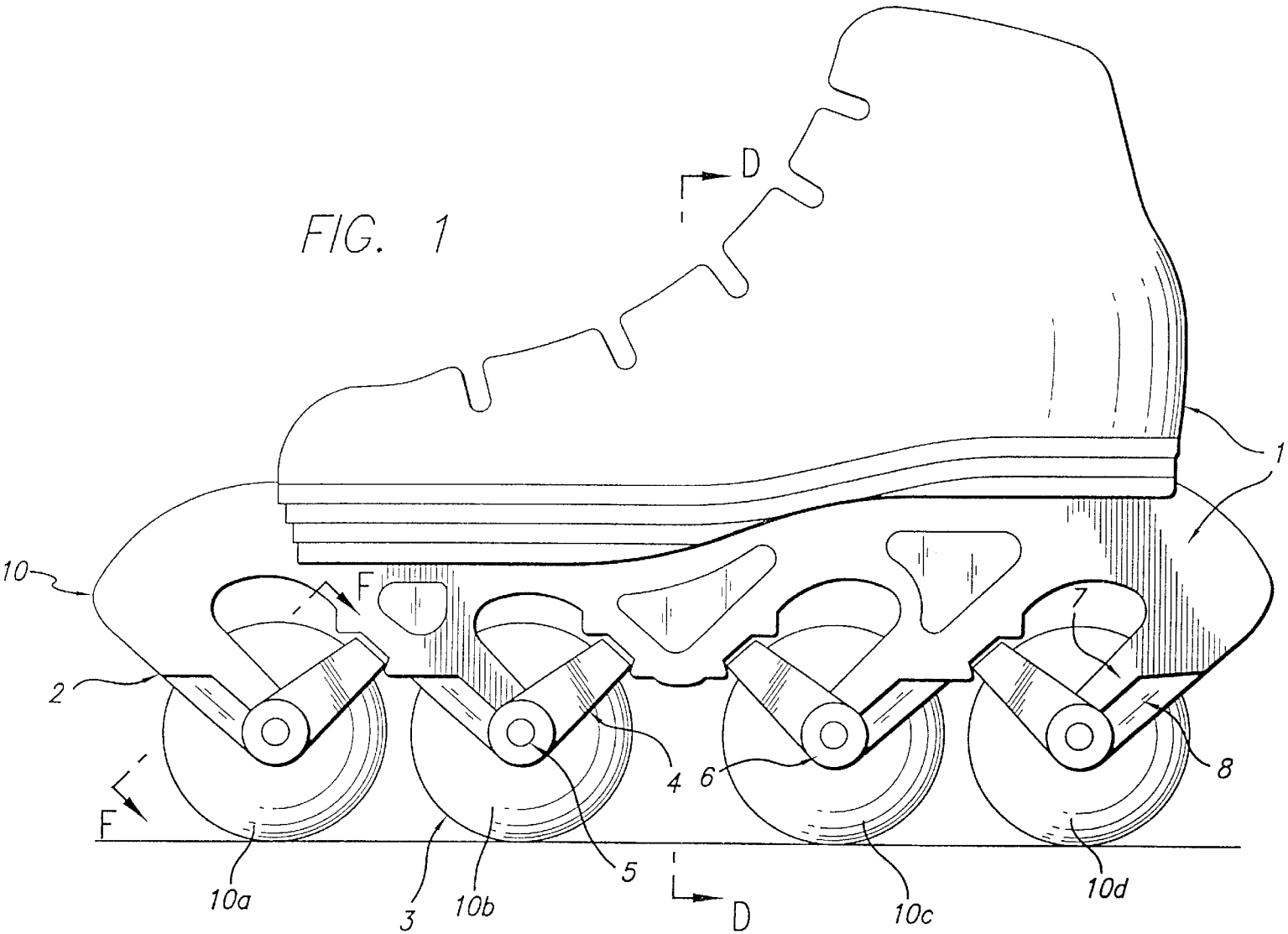
FIG. 1 is a side view of a first embodiment of a roller skate boot assembly according to the present invention.

Referring to FIG. 1, a first embodiment of the present invention is shown. In all the illustrated embodiments of the present invention the truck is applied to various roller skate configurations. However, the invention is equally applicable to scooters, unicycles, wheel barrows, sleds, toboggans, skis or ski vehicles, vehicles with runners, and vehicles with pontoon structures, and is not meant to be limited to a roller skate embodiment.

Figure 2:
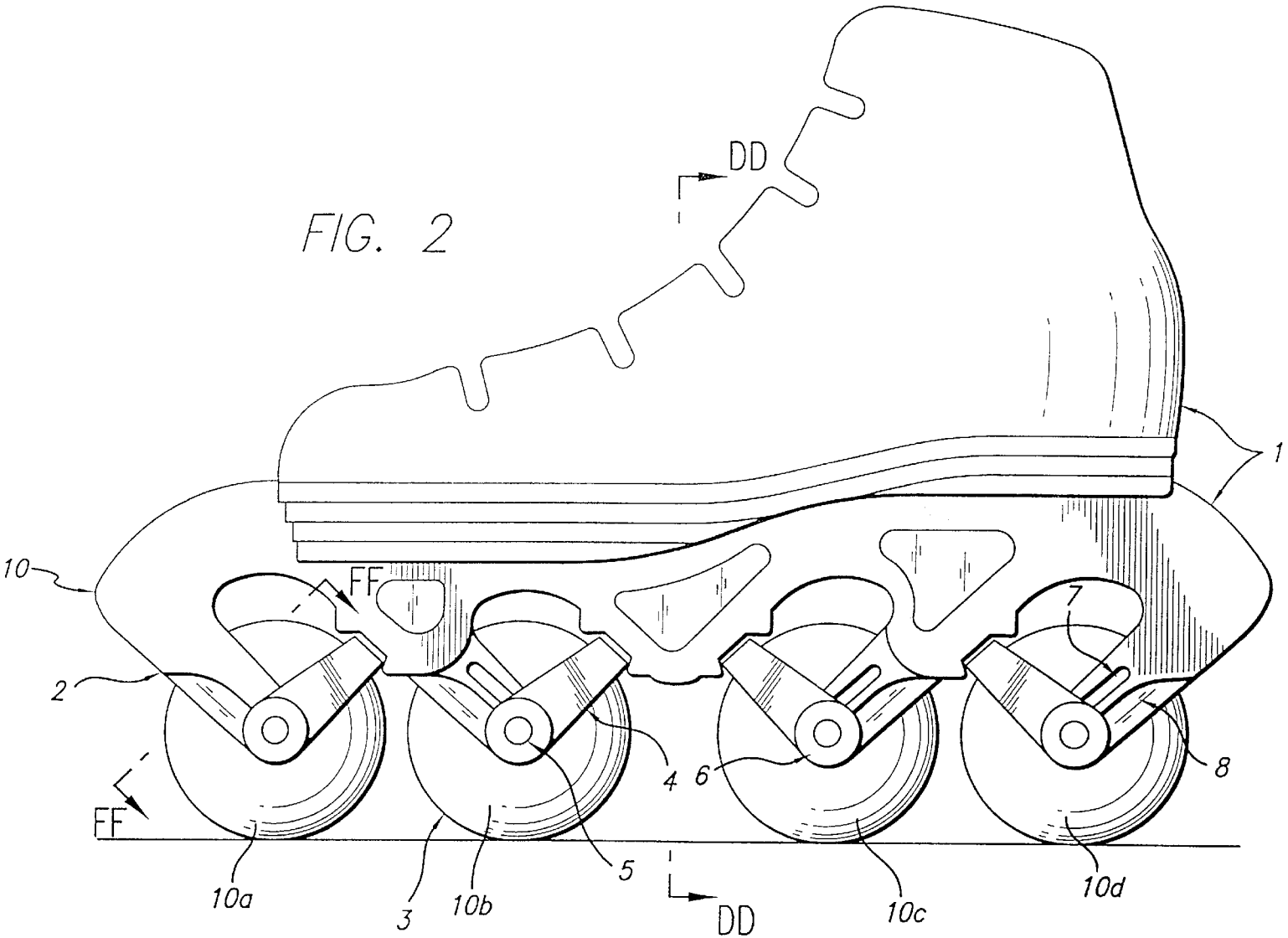
FIG. 2 is a side view of a second embodiment of a roller skate boot assembly according to the present invention.

In the embodiment shown in FIGS. 1 and 2, the skate boot and mounting structure are integrally formed as a unitary structure 1 with one another. The structure, unitary or otherwise, can be formed by injection molding, centrifugal molding or similar unitary processes. The other vehicles mentioned above can also be formed as a unitary structure, and mention of these other vehicles will be omitted from now on, but when reference is made to a skate the other vehicles are intended to be included.

The embodiment of FIGS. 1, 3, 6, 7, 11, and 12 has four wheels 3 arranged in an in-line configuration. Each wheel 3 is supported by an axle 5 held in an axle hanger 6. The truck in this embodiment has two flexible deflecting members for each wheel 3, one on either side of each wheel 3. Each flexible deflecting member 2 has a truck axle hanger 6 at one end and the other end connected to the mounting structure 1. The end attached to the mounting structure 1, meets the mounting structure 1 at an acute angle, less than 90 degrees.

Figure 3:
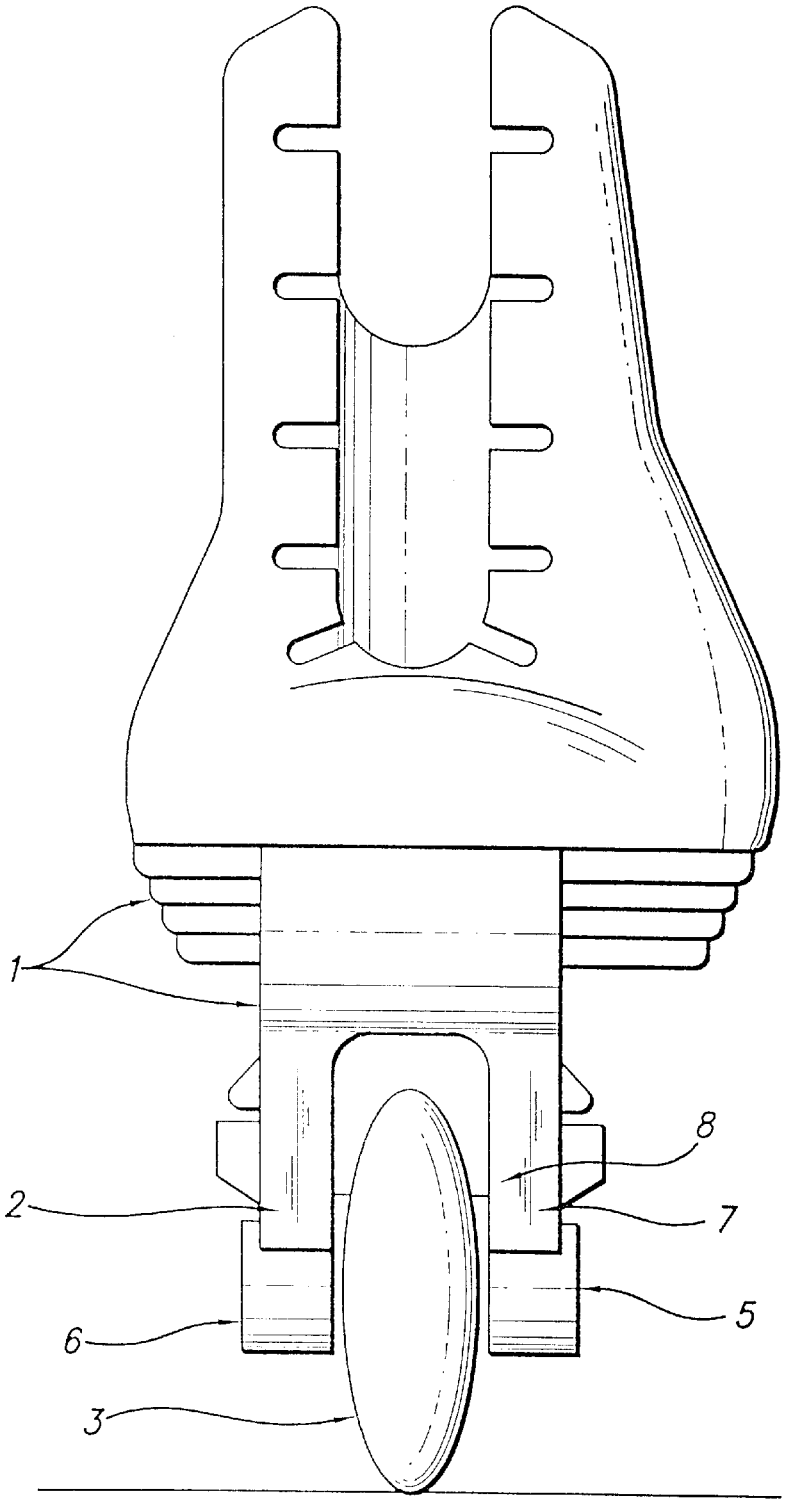
FIG. 3 is a front view of the roller skate boot assembly shown in FIG. 1.
Figure 4:
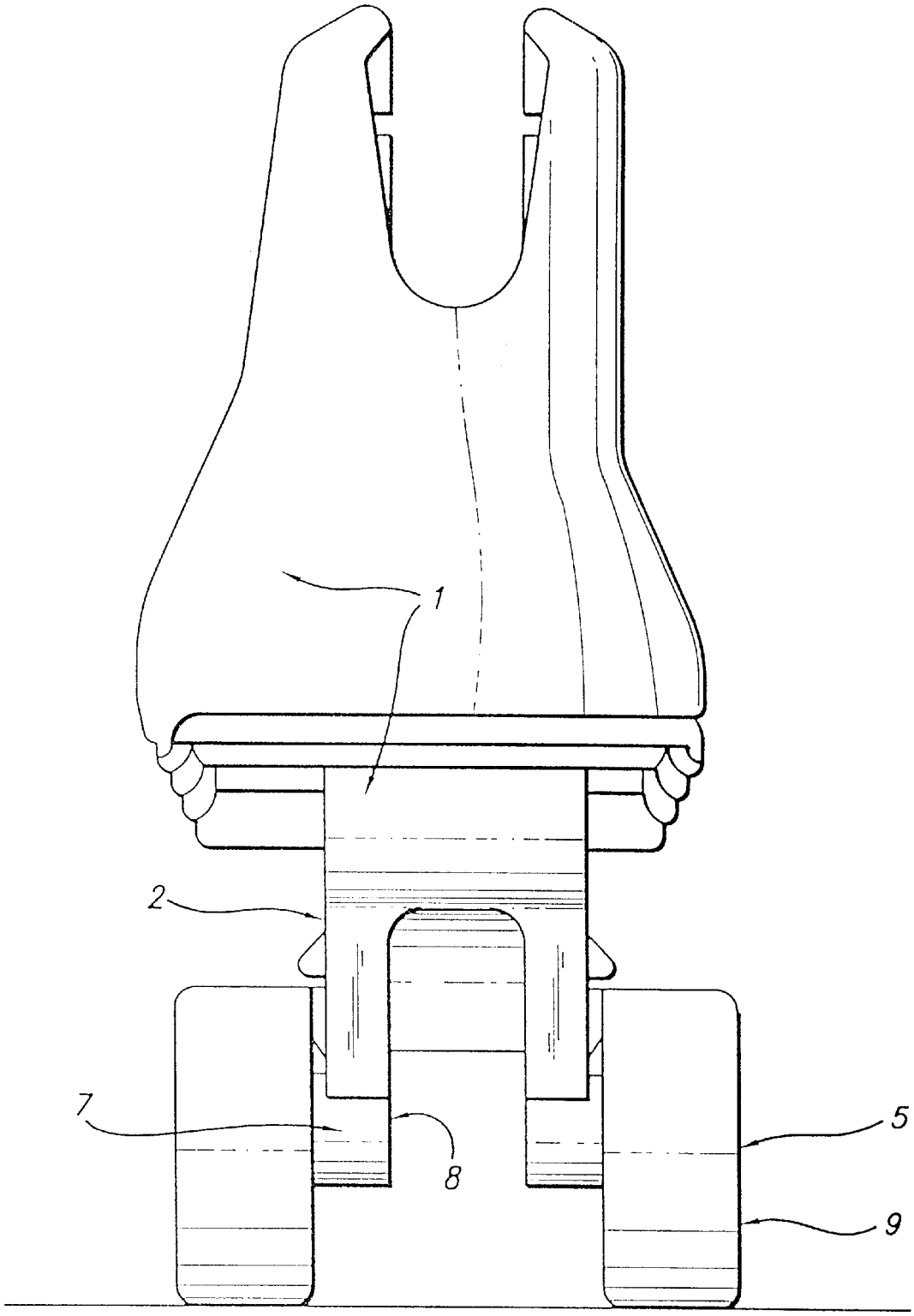
FIG. 4 is a rear view of the roller skate boot assembly similar to the boot shown in FIG. 1, but having tandem wheels instead of in-line wheels.
Figure 5:
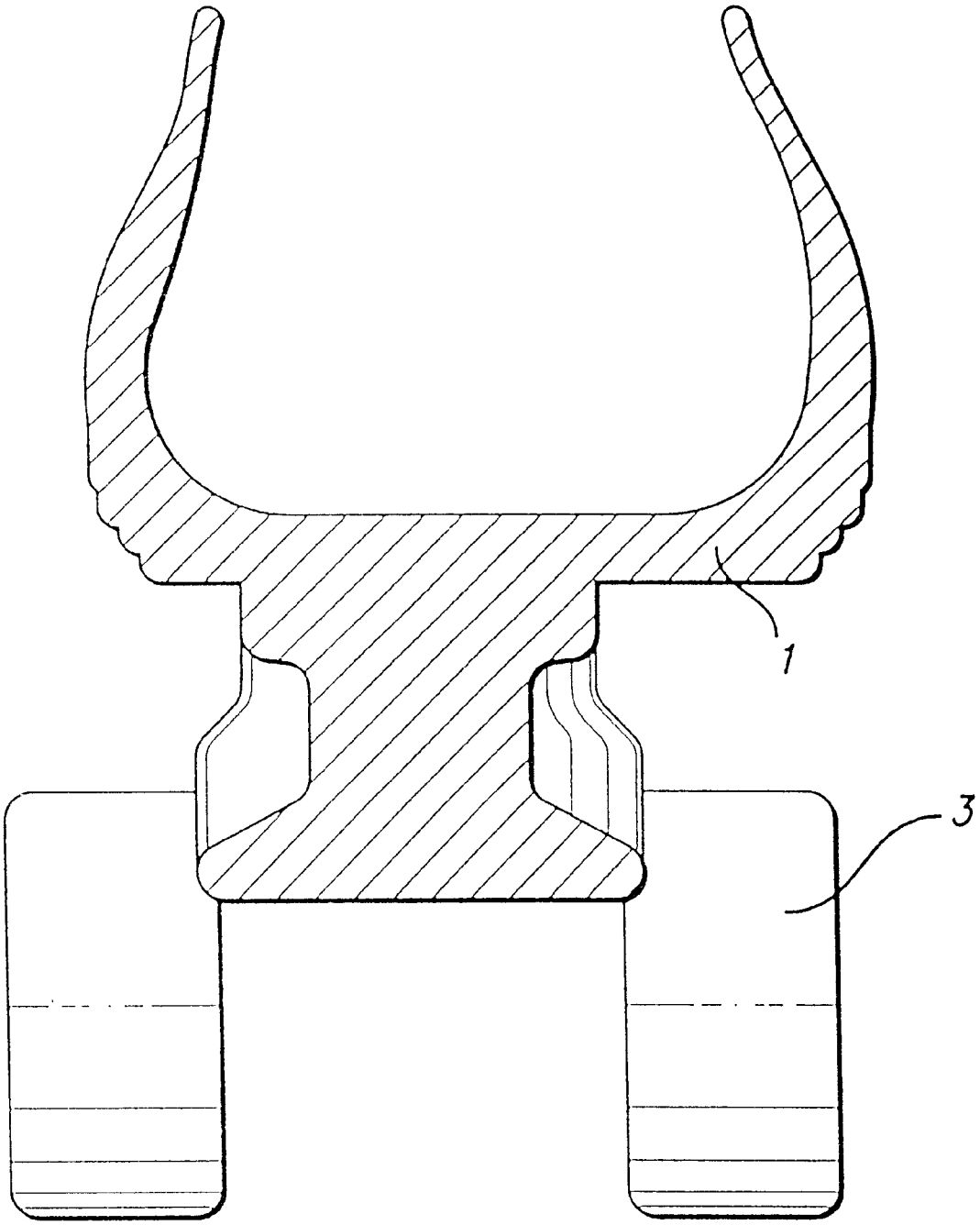
FIG. 5 is a cross-sectional view of the truck and boot of FIG. 4.
Figure 6:
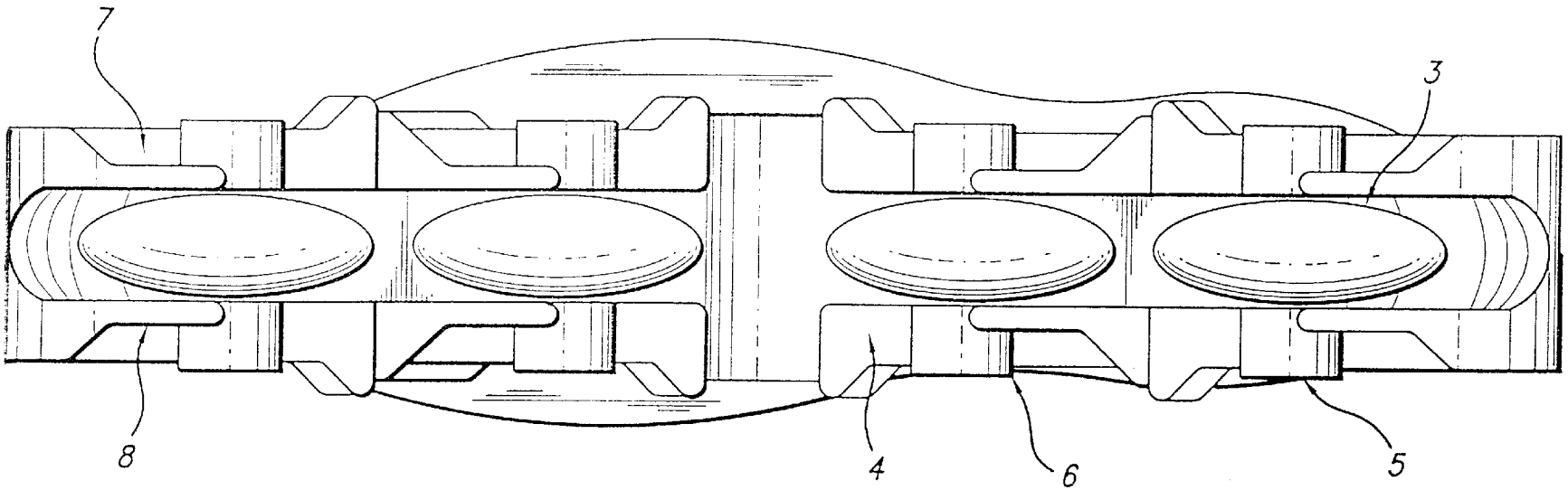
FIG. 6 is a bottom view of the roller skate assembly shown in FIG. 1.

As shown most clearly in FIGS. 3 and 6, each wheel 3 has an axle hanger 6 on either side with a flexible deflecting beam 2 joining each hanger 6. Referring back to FIG. 1, four trucks 10 are attached to the mounting surface 1, each at an acute angle. The apex of the front-most truck 10*a* points forwards away from the toe of the boot and meets the mounting surface 1 at the front end 1*a* of the mounting surface 1. The rearmost truck 10*d* is attached so that the apex of the acute angle points rearward away from the heel of the boot, and meets the mounting surface 1 at the rear end 1*d*. In the embodiment of FIG. 1, the front two trucks 10*a* and 10*b* are oriented in the same direction with their apexes pointing forwards, while the rear two trucks 10*c* and 10*d* are oriented with their apexes pointing rearward.

The acute angle of the trucks 10 relative to the mounting structure 1 can be either fixed and non-adjustable or can be changeable. The preferred embodiment of the truck 10 has an optimum angle of approximately 45 or less degrees. Such a configuration provides the best shock absorption, wobble reduction and turning-in response-to-force action.

During turning two separate arcs are created, because the front wheel 10*a* and rear wheel 10*d* flex so as to follow one arc while the inner wheels 10*b* and 10*c* follow a separate arc, due to the various stresses, thereby creating two tracks of travel which increases stability when turning.

Figure 7:
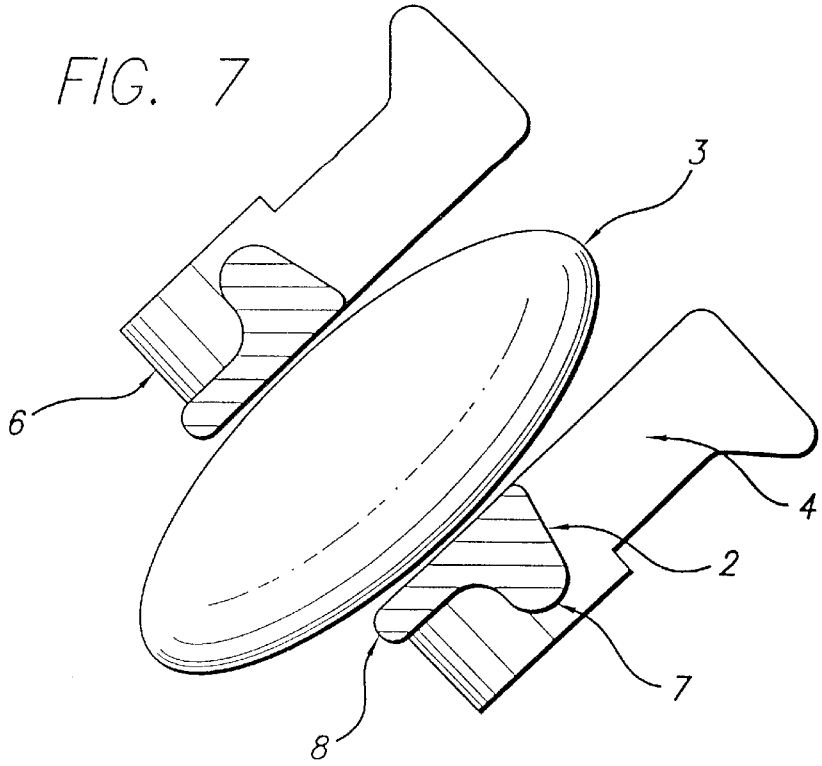
FIG. 7 a cross-sectional view taken along line F—F of FIG. 1.
Figure 8:
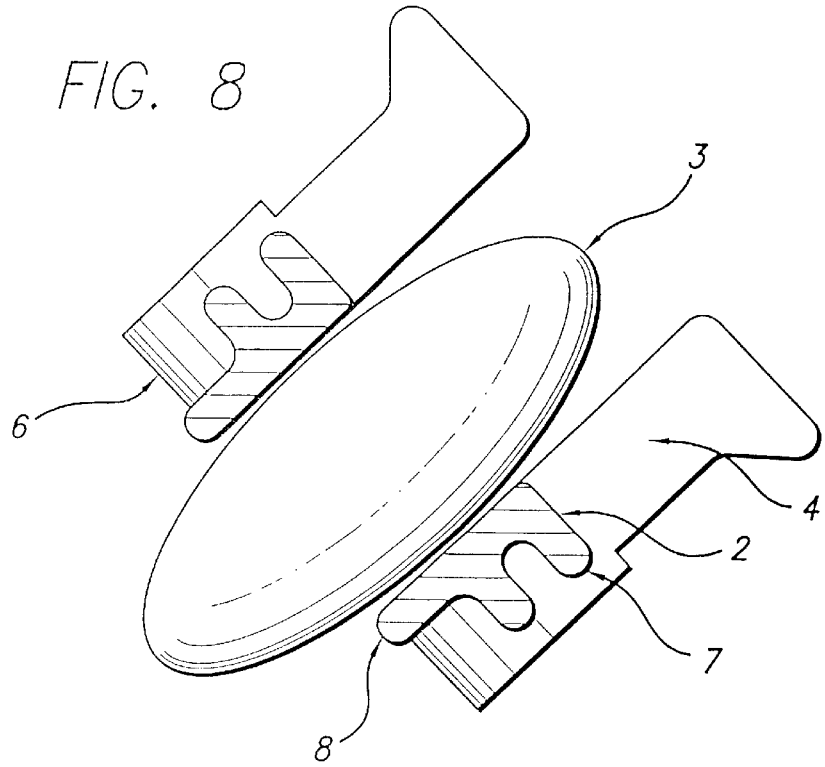
FIG. 8 is a cross-sectional view taken along line FF—FF of FIG. 2.
Figure 9:
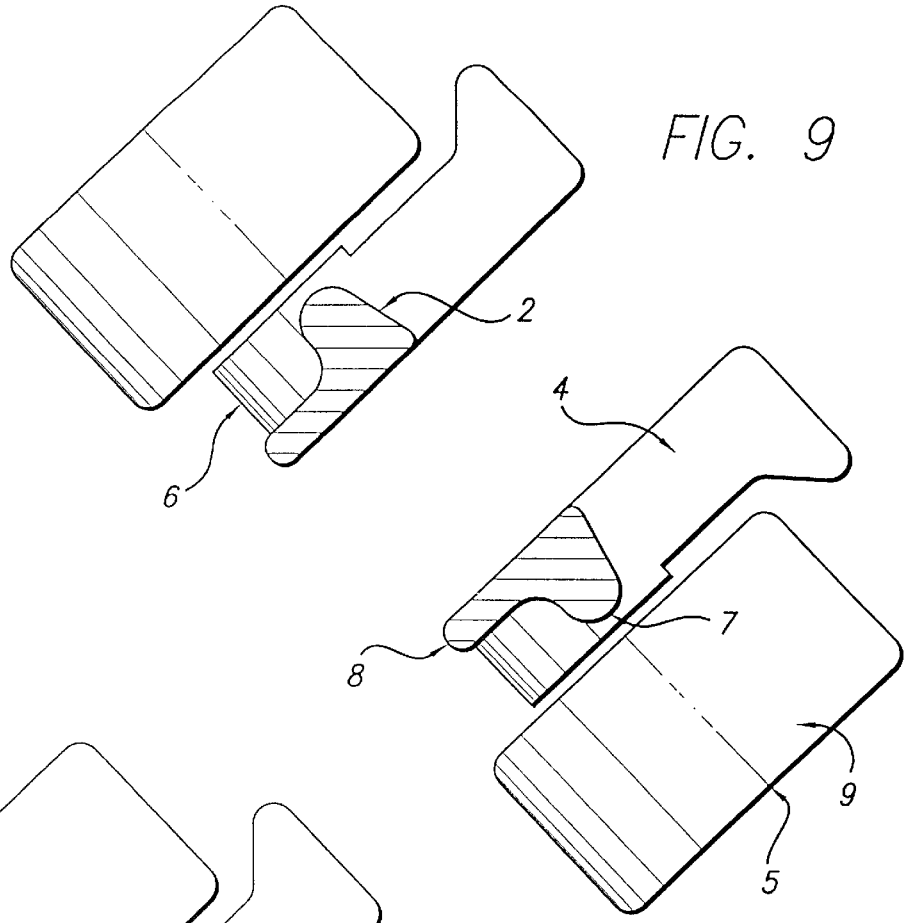
FIG. 9 is a cross-sectional view of the truck of FIG. 4 where the truck supports pairs of wheels side-by-side.
Figure 10:
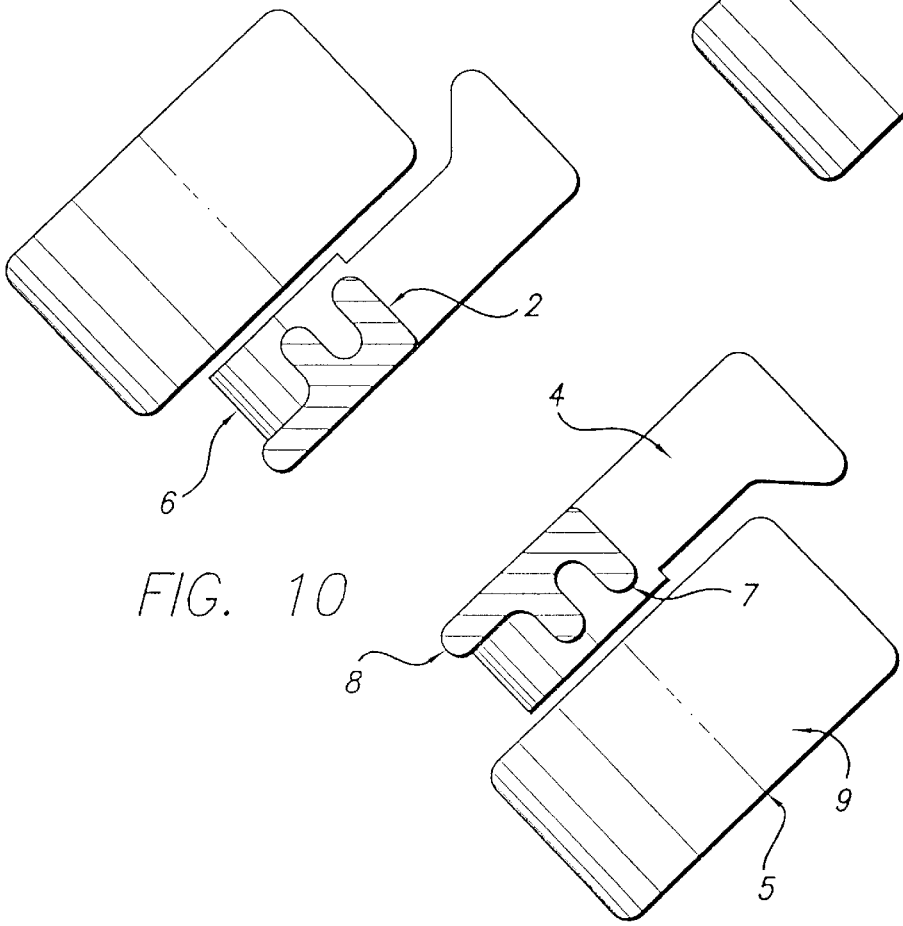
FIG. 10 is a cross-sectional view of the truck of FIG. 4 having a configuration similar to the second embodiment where the truck supports pairs of wheels side-by-side.
Figure 11:
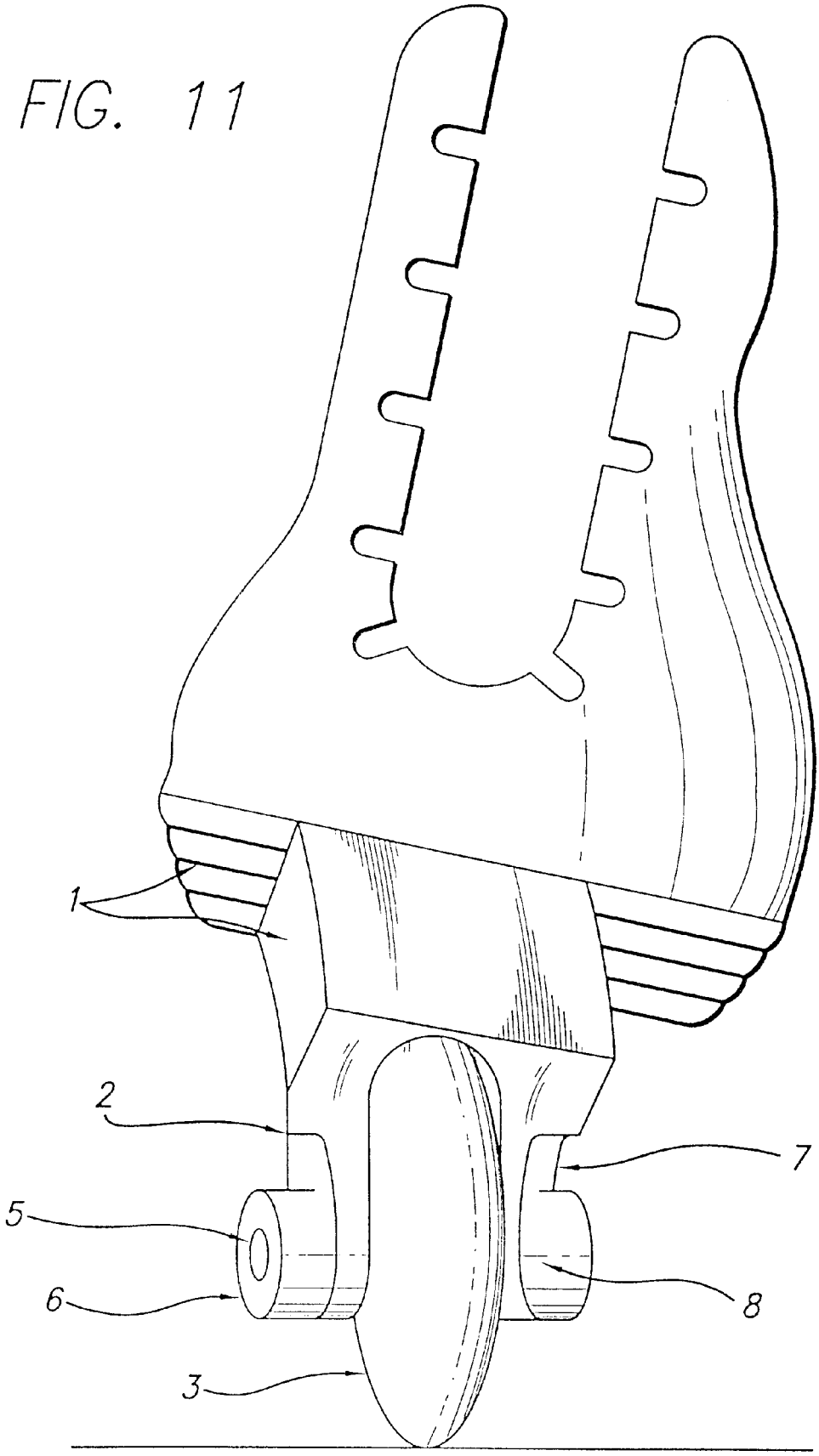
FIG. 11 is a frontal view of the embodiment shown in FIG. 1.
Figure 12:
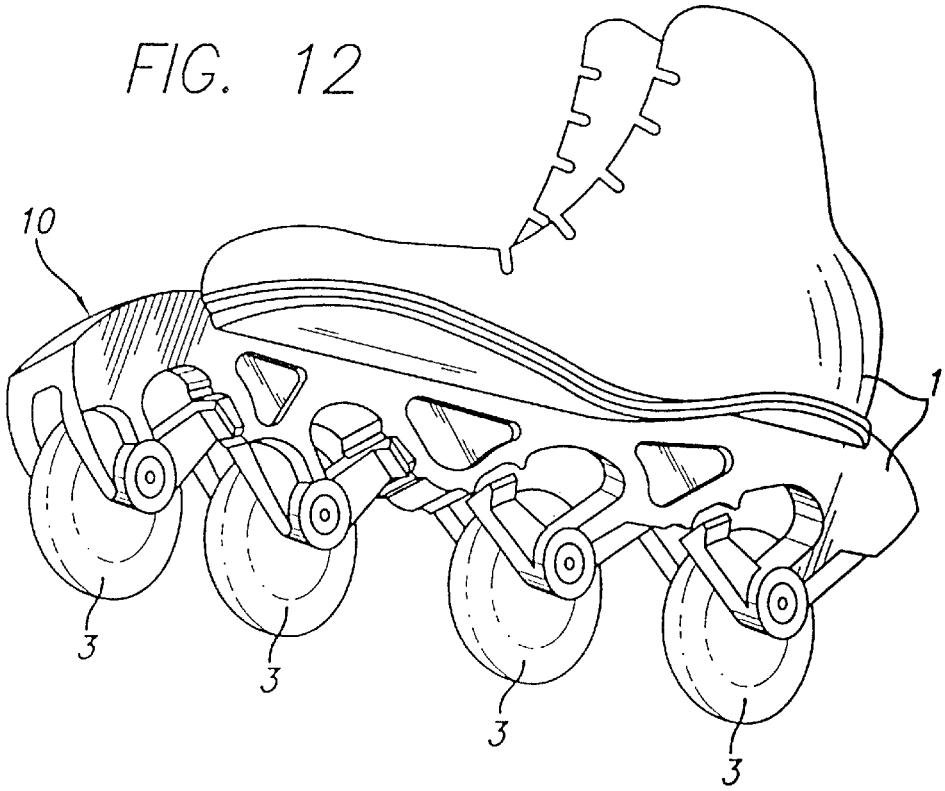
FIG. 12 is perspective view of the embodiment shown in FIG. 1.
Figure 13:
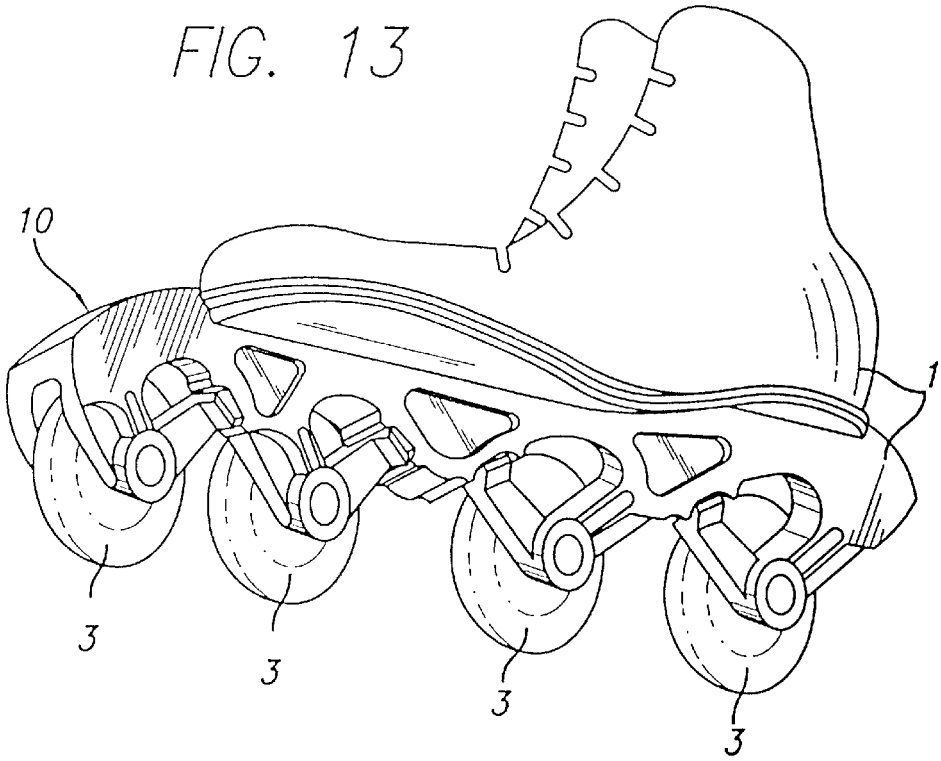
FIG. 13 is perspective view of the embodiment shown in FIG. 2.
Figure 14:
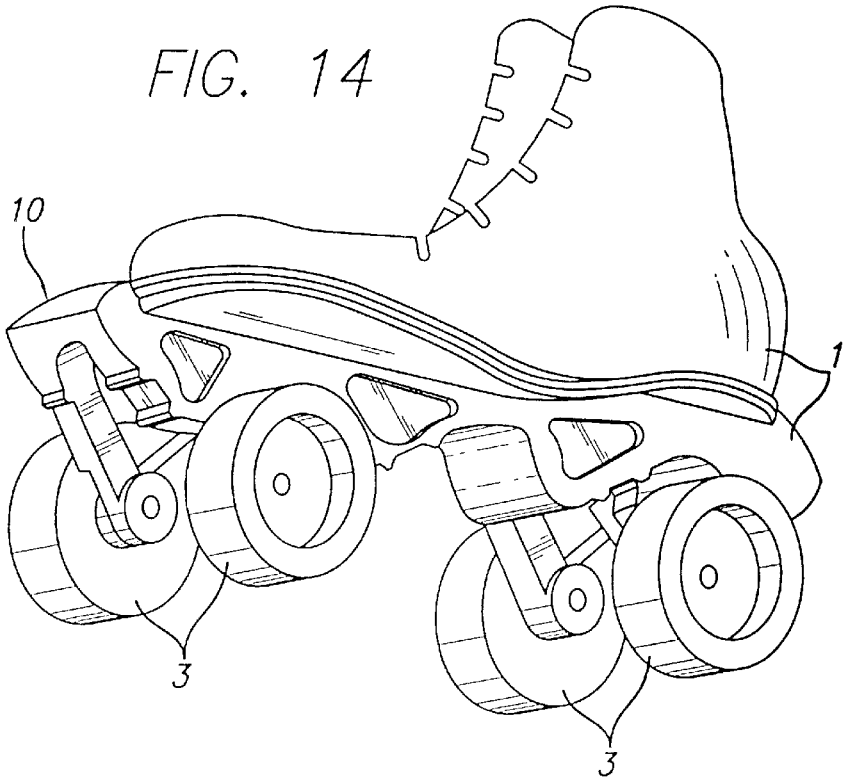
FIG. 14 is perspective view of a skate boot as shown in FIG. 4 with two pairs of tandem wheels.

Turning now to FIGS. 3 and 7, the configuration of the flexible deflecting beams 2 will be described. Each flexible deflecting member 2 can include a vertical component 8 and or a horizontal component 7. The flexible deflecting beams 2 may have only a single vertical component 8, a single horizontal component 7, or one or more of each. In the embodiment shown in FIGS. 1, 3, 6, 7, 11, and 12 there is one vertical component 8 and one horizontal component 7. On the other hand the embodiment of FIGS. 2, 8, 13, 16 and 17, has one vertical component 8 and two horizontal components 7. The flexible deflecting beam 2 may have two or more vertical components 8 as well, although such an embodiment is not illustrated.

The vertical component 8, shown most clearly in FIG. 7 is designed to resist vertical deflection of the truck axle hangers 6 to thereby restrict the upward and downward movement of the wheels so that the truck 10 has greater shock absorbing properties. The vertical component 8 also acts as the center of movement for turning of the flexible deflecting member 2.

The horizontal component 7 affects the twisting motion of the flexible deflecting beam 2. The thicker the horizontal component 7 is relative to its width, the less the flexible deflecting beam 2 will twist away from a particular force applied to the axle hanger 6 or the mounting structure 1. The horizontal component also acts as a dampener for side-to-side axle hanger wobble, especially wobble in the rear-most truck, which can be caused by vibratory or unstable movement of the wheel 3 when moving at speed. The wider the horizontal component 7 the less side-to-side movement will result since the flexible deflecting beam 2 is thereby more resistant to compression and elongation caused by vibration and other destabilizing movement of the wheel. The horizontal component 7 can also effect the shock absorption of the truck 10. If the horizontal component 7 is very thick and made of a stiff material it can resist vertical deflection within itself, reducing or eliminating the need for a vertical component 8.

The preferred embodiment of the flexible deflecting beam 2 is shown in FIG. 7, and has one vertical component 8 and one horizontal component 7 which are merged together at the upper edge of the vertical component 8 and the inner edge of the horizontal component 7. Even a small vertical component 8 in a merged structure such as shown in FIG. 7 provides significant enhancement of the shock absorption properties of the flexible deflection beam 2.

Each truck 10 in the illustrated embodiments also has a peg 4 which acts as a truck movement restrictor which keep the truck hangers 6 and wheels 3 from bottoming out on the mounting structure 1. The pegs 4 may also include a twist or turning resistant component. The pegs 4 also help to prevent dead weight sag resulting from the flexibility of the flexible deflecting beam 2, especially in the independent or semi-independent tandem wheel design, illustrated in FIGS. 4, 5, 9, 10, and 14. Each peg may be rigidly attached to or integrally formed with either the axle hanger 6. Or the mounting surface 1 as shown in FIG. 1*a* while the opposite end is not attached to the device. In the illustrated embodiments the pegs 4 are integrally formed with the axle hangers 6.

Each peg 4 can be formed of rigid material and thus provide no spring action or can include large or small springs or dampeners or have buffer pads to provide a shock absorbing function in addition to their primary function of preventing the wheels from bottoming out. The pegs 4 can also act in the stead of a missing or reduced vertical component 8 of the flexible deflecting beam 2. The pegs 4 can be formed integrally with the mounting structure 1, or formed separately so they are removable and replaceable.

The embodiment shown in FIGS. 2, 8, 13, 16, and 17, employs two horizontal components 7 and a single vertical component 8 in the flexible deflecting beam 2 to enhance the resistance to twisting forces. While it is not illustrated, multiple vertical components 8 may be employed where greater shock absorption is desired.

Figure 15:
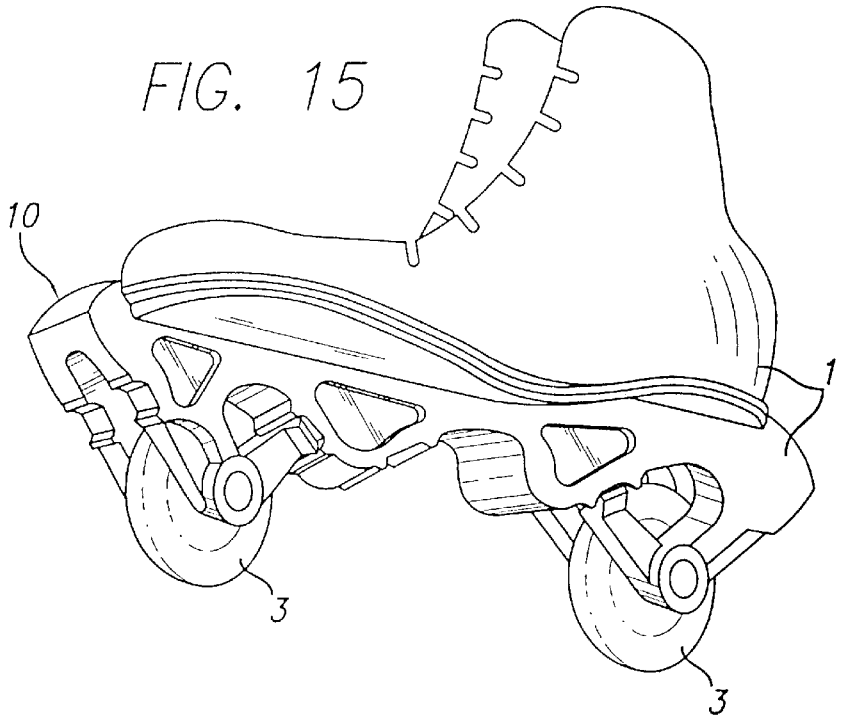
FIG. 15 is a perspective view of the skate boot of FIG. 1 which has been modified to support two wheels aligned in a single line, the wheels being very thin.
Figure 16:
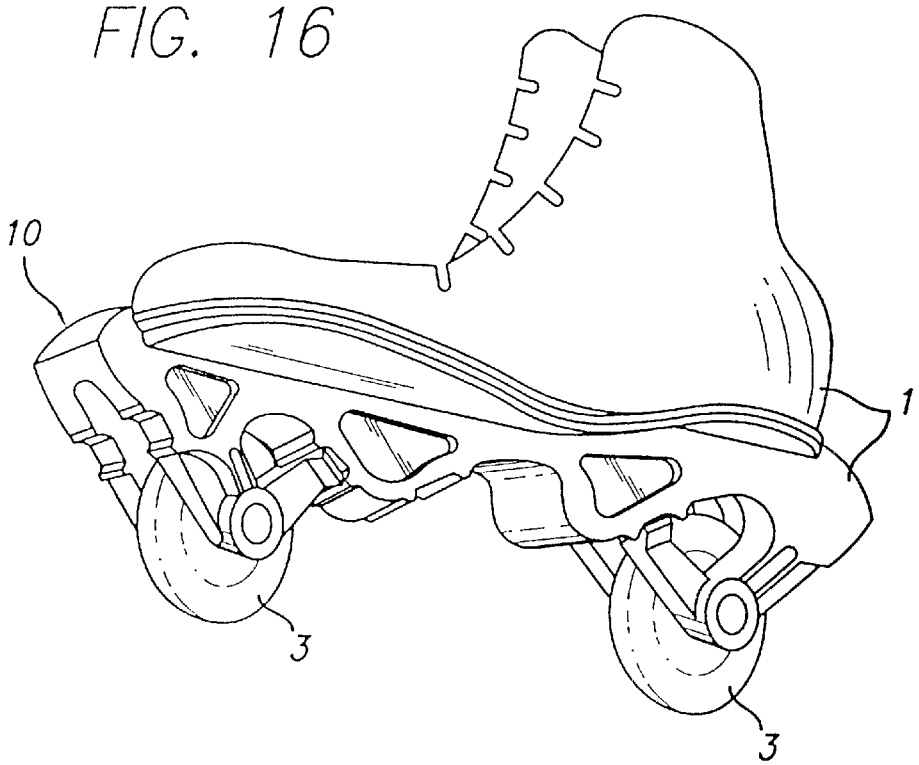
FIG. 16 is a perspective view of the skate boot of FIG. 2 which has been modified to support two wheels aligned in a single line, the wheels being of medium thickness.
Figure 17:
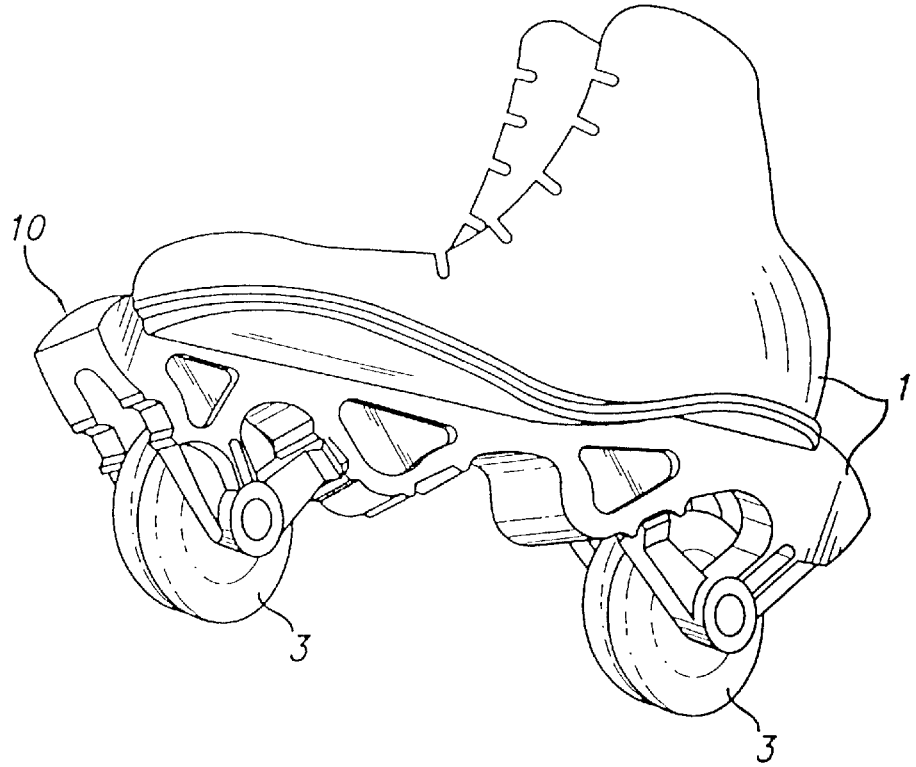
FIG. 17 is a perspective view similar to FIG. 16 where the wheels have been replaced with extra wide wheels.

Another aspect of the present invention is the adaptability of the design by changing the distance between axle hangers 6 to allow for the use of different size wheels, blades, pontoons, skids, skis etc. FIG. 15 shows a skate similar to the first embodiment with two wheels. If all or some of the trucks 10 are not integrally formed with the mounting structure 1, then the user can vary the number of wheels on the skate by detaching one or more trucks 10. The user can further adapt the skate to their personal needs by altering the distance between the axle hangers 6 to employ different width wheels which result in different operating characteristics. FIG. 15 shows two wheels which are extremely thin. FIG. 16 shows a skate with flexible deflecting beam 2 according to the second embodiment, the skate having two in-line wheels 3, the wheels 3 being of intermediate width. The skate shown in FIG. 17 is the same as the skate in FIG. 16, but the axle hangers 6 have been mounted so that they are farther apart to permit the mounting of double thick wheels. In this manner beginner skaters, lacking stability and muscle tone can employ the wider wheels and then change to the thinner wheels as their skills increase. Further, the performance characteristics can be altered to suit the rider or user by changing the wheel size, position or supports.

The mounting structure can be a plate, a shoe with an integral truck/plate, or truck/shoe, a one-piece molded shoe, scooter, etc. wherein all components are molded at the same time. For some parts such as the pegs it may be desirable to make them from separate pieces.

The molded construction of the truck and mounting structure of the present invention can be altered for use in the variety of applications mentioned previously, namely, for skates scooters, sleds, unicycles, etc. The mount structure can be designed to attach to the bottom of a user's shoe. This list is not meant to be limited to the specific vehicles mentioned but is equally applicable to any vehicle having a ground contacting member and a support therefor.

The molded truck and mounting platforms can be formed with variations, recesses and/or attachment points for various components, such as but not limited to, toe-stops, lights, reflectors, batteries, power packs, and radios.

While the preferred embodiment was described in detail, modifications and variations of the present invention that are obvious to one skilled in the art, such as changing the dimensions, are intended to be covered by the following claims.

What is claimed is:

1. A skate vehicle for supporting a plurality of wheels comprising:

at least one truck and mounting structure for mounting said at least one truck to said skate vehicle, said at least one truck comprising at least one flexible deflecting beam member having portions in at least two intersecting planes, along a major portion of the length of said flexible deflecting beam member, for attachment to at least one of said wheels, said at least one flexible deflecting beam member supporting no more than one wheel, said at least one flexible deflecting beam member connected to the bottom surface of, and extending downward from said mounting structure, said flexible deflecting beam member resisting vertical deflection of said truck and twisting of said truck and wobble of said wheel, and a safety peg disposed between said mounting structure and a place of contact of said mounting structure on said at least one flexible deflecting beam member said flexible deflecting beam member of a front one of said wheels meeting, and extending downwardly and rearwardly from said mounting structure at a first acute angle, the apex of said acute angle facing rearwardly of the place of attachment of said flexible deflecting beam member to said bottom surface of of said mounting structure.

2. The skate vehicle of claim 1 further comprising at least two wheels and at least two trucks mounted to said mounting structure, said trucks comprising at least one rearward and one forward flexible deflecting beam member for attachment to at least one of said at least two wheels, said flexible deflecting beam members each supporting no more than one wheel, said rearward, and said forward, flexible deflecting beam members having portions in at least two intersecting planes along a major portion of their length, said flexible deflecting beam members resisting vertical deflection and wherein said at least one rearward flexible beam member extends downwardly and forwardly from said mounting structure at a second acute angle, and said second acute angle faces forward of the place of attachment of said at least one rearward flexible deflecting beam member to said mounting structure.

3. A skate vehicle as recited in claim 2, wherein each of said wheels has one of said flexible deflecting members disposed on either side of each of said wheels.

4. A skate vehicle, as recited in claim 2, and wherein said truck comprises more than one flexible deflecting member, and wherein the number of wheels can be changed.

5. A skate vehicle as recited in claim 2, wherein at least one of said mounting structure, and at least one said flexible deflecting member are integrally formed.

6. A skate vehicle as recited in claim 1, wherein each of said wheels has one of said flexible deflecting members disposed on either side of each of said wheels.

7. A skate vehicle, as recited in claim 1, wherein said truck comprises more than one flexible deflecting member, and wherein the number of wheels can be changed.

8. A skate vehicle as recited in claim 1, wherein at least one of said mounting structure, and at least one said flexible deflecting member are integrally formed.

* * * * *